US007895839B2

(12) United States Patent
Miller

(10) Patent No.: US 7,895,839 B2
(45) Date of Patent: Mar. 1, 2011

(54) COMBINED CIRCULATION CONDENSER

(75) Inventor: Steven Richard Miller, Kailua Kona, HI (US)

(73) Assignee: Steven Richard Miller, Kealakekua, HI (US)

( * ) Notice: Subject to any disclaimer, the term of this patent is extended or adjusted under 35 U.S.C. 154(b) by 573 days.

(21) Appl. No.: 11/869,418

(22) Filed: Oct. 9, 2007

(65) Prior Publication Data

US 2008/0041055 A1 Feb. 21, 2008

Related U.S. Application Data

(63) Continuation-in-part of application No. 11/164,848, filed on Dec. 7, 2005, now abandoned.

(51) Int. Cl.
*F01K 9/02* (2006.01)

(52) U.S. Cl. ..... 60/692; 60/685

(58) Field of Classification Search ..... 60/685–697
See application file for complete search history.

(56) References Cited

U.S. PATENT DOCUMENTS 3,593,540 A 7/1971 Hopkins
3,935,902 A * 2/1976 Heller et al. ..... 165/110
4,509,591 A 4/1985 Kals
4,631,925 A * 12/1986 Ohtake et al. ..... 60/688
4,776,170 A * 10/1988 Blangetti ..... 60/689
5,174,123 A 12/1992 Erickson
5,357,746 A 10/1994 Meyers et al.
5,419,155 A 5/1995 Boehde et al.
5,423,377 A 6/1995 Iwata et al.
2007/0125084 A1 6/2007 Miller

* cited by examiner

*Primary Examiner* — Hoang M Nguyen
(74) *Attorney, Agent, or Firm* — McCormick, Paulding & Huber LLP

(57) ABSTRACT

A combined circulation condenser for a steam cycle apparatus is disclosed. The steam cycle apparatus includes a steam generator with a port for receiving a fluid. The steam generator presents heat to the fluid to generate steam that is directed out another port, which presents the steam to a turbine to generate electrical power. The turbine has an outlet that directs an exhaust steam into a condenser. A fluid flow system is inside the condenser, which directs cooling water along a pathway through the condenser so that the cooling water cools the exhaust steam, forming condensate. A condensate pump collects and pumps the condensate along another pathway through the condenser so that the condensate can additionally cool the exhaust steam. Simultaneously, the exhaust steam warms the condensate. This pathway directs the condensate to a feed pump, which pumps the condensate back to the steam generator through the generator's input port.

4 Claims, 1 Drawing Sheet

COMBINED CIRCULATION CONDENSER

CROSS REFERENCE TO RELATED APPLICATIONS

This application is a continuation-in-part of U.S. patent application Ser. No. 11/164,848, filed on Dec. 7, 2005, titled "COMBINED CIRCULATION CONDENSER," herein incorporated by reference in its entirety.

FIELD OF THE INVENTION

This invention relates in general to a combined circulation condenser. More particularly, the invention deals with a combined circulation condenser that increases the efficiency of a steam cycle apparatus by pumping condensate back through the condenser rather than sending the condensate directly back to a steam generator.

BACKGROUND OF THE INVENTION

Various designs of condenser and cooling systems exist in the field of energy generation by steam turbines. However, it has become increasingly important to improve efficiency in order to conserve fuel and resources.

The traditional steam cycle uses high-energy steam to operate turbines or auxiliary equipment and exhausts the steam into a condenser. In thermal power plants, a steam generator creates steam, which is sent to a turbine. The steam turbine converts the heat in the steam to mechanical power. Any remaining steam is exhausted. A condenser condenses the exhaust steam from a steam turbine by using a cooling medium such as water or air. The condensed water is known as condensate. The condensate can either be considered waste or be reused in a steam generator. This process of cooling is known as subcooling.

If reused, a condensate pump pumps the condensate to a feed pump. The feed pump then pumps the condensate to the steam generator so that the condensate can be reheated and turned to steam for use again in the turbine.

Previous attempts at increasing efficiency have failed due to the problem of subcooling the exhaust steam. Subcooling is required to allow the condensate pumps to pump the water forward without cavitation. In addition, subcooling increases the efficiency of the turbines. However, each degree that the steam and condensate is cooled is heat energy that must be put back into the condensate to convert it back into steam. Thus, excessive subcooling actually decreases the efficiency of the steam cycle.

With the forgoing problems and concerns in mind, it is the general object of the present invention to provide a combined circulation condenser, which overcomes the above-described drawbacks while increasing the efficiency of the turbine and steam cycle.

SUMMARY OF THE INVENTION

It is an object of the present invention to provide a combined circulation condenser that increases the efficiency of a steam cycle.

It is another object of the present invention to provide a combined circulation condenser that uses less fuel for a given power level.

It is another object of the present invention to provide a combined circulation condenser that allows subcooling of the condensate.

It is another object of the present invention to provide a combined circulation condenser that increases the efficiency of a turbine and condensate pump.

It is another object of the present invention to provide a combined circulation condenser that recovers the lost heat energy of the condensate.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
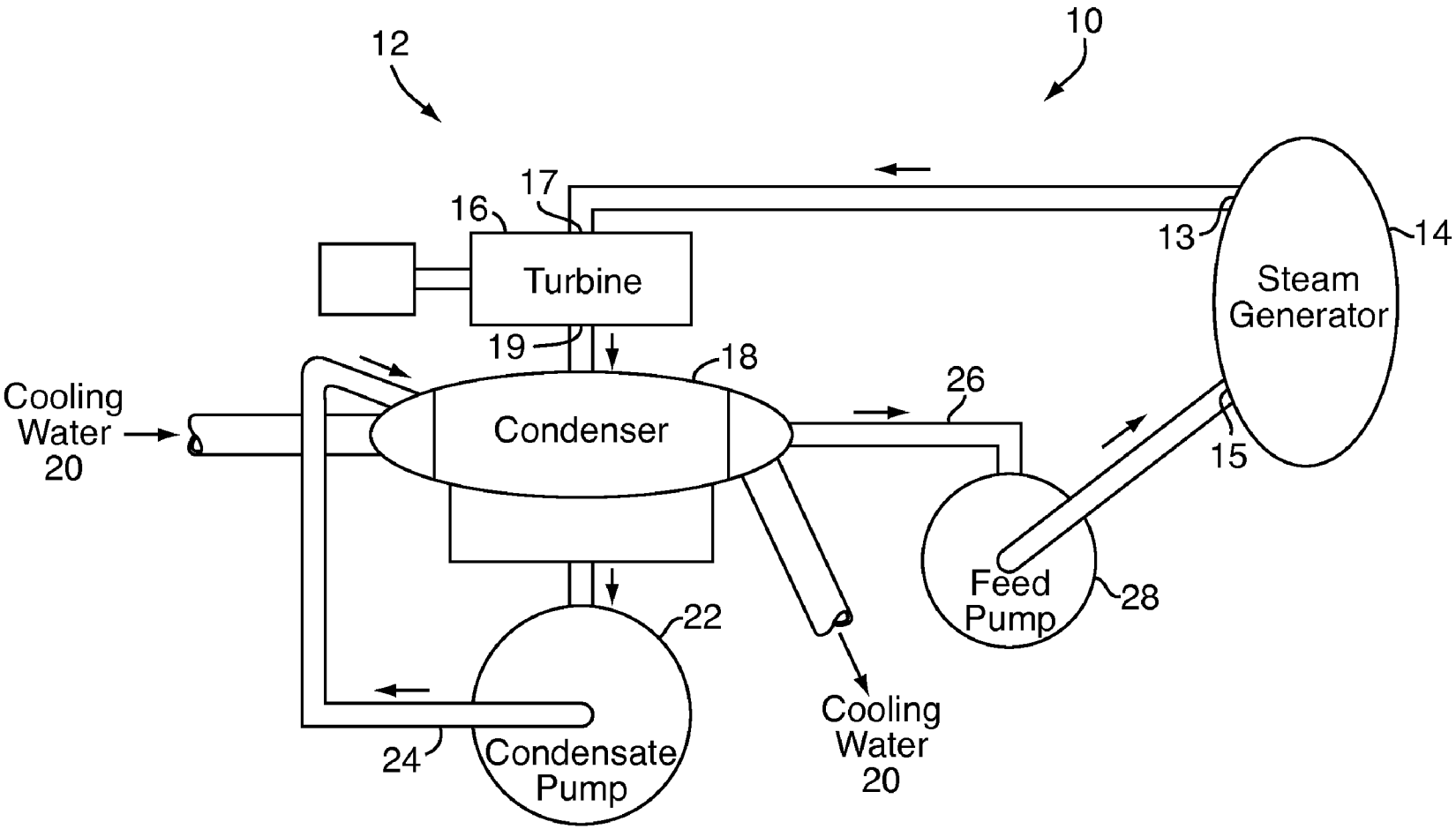
FIG. 1 is a schematic view of a combined circulation condenser according to one embodiment of the present invention.

The present invention is designed to increase the overall efficiency of a steam cycle. More specifically, the present invention allows less fuel to be consumed in generating power, which conserves both fuel and resources. The present invention seeks to address the shortcomings of subcooling in prior systems while not decreasing the overall efficiency of a steam cycle.

FIG. 1 illustrates a schematic view of a combined circulation condenser 10 as part of a steam plant cycle 12 according to one embodiment of the present invention. The steam plant cycle 12 begins with a steam generator 14. The steam generator 14 includes an output port 13 and an input port 15. The input port 15 is adapted to receive a fluid. The steam generator 14 presents heat to the fluid to generate steam for use by a turbine 16. The steam from the steam generator 14 is directed out of the output port 13 to an inlet 17 on the turbine 16. The inlet 17 is adapted to receive the steam from the steam generator 14. The turbine 16 converts the heat in the steam to mechanical power. The remaining steam and its heat energy is exhausted into a condenser 18 through an outlet 19 of the turbine 16.

Within the condenser 18, cooling water 20 is controllably directed through a fluid flow system, shown as a pipe pathway in FIG. 1, according to the operation of the turbine 16. The exhaust steam from the turbine 16 is cooled as it passes the cooling water 20 in the pipes. This heat exchange condenses the exhaust steam to form water known as condensate. The cooling water 20 is then expelled as waste or may be cooled again for reuse.

After forming, the condensate exits the condenser 18 via a condensate pump 22. The condensate pump 22 is adapted to receive the condensate and pumps the condensate through the condensate entry pipe 24. The condensate entry pipe 24 travels back through the condenser 18, which in effect, also sends the condensate through the condenser 18. Through heat exchange, the exhaust steam is cooled by the condensate, and the condensate is warmed. After the condensate travels through the condenser 18 via condensate entry pipe 24, the condensate exits the condenser 18 via condensate exit pipe 26. The condensate exit pipe 26 directs the condensate into a feed pump 28. The feed pump 28 pumps the warmed condensate back to the steam generator 14 through its input port 15 so that the condensate may be converted back into steam for use by turbine 16, and the steam plant cycle 12 begins again.

The present invention is specifically directed toward the combined circulation condenser 10, which represents an arrangement heretofore unknown in the art. The combined circulation condenser 10 includes the condenser 18, the condensate pump 22, the condensate entry pipe 24, and the condensate exit pipe 26.

It is an important aspect of the present invention that the condensate, after leaving the condenser 18, is pumped back through the condenser 18 in the condensate entry pipe 24. The condensate passing through the condensate entry pipe 24 acts as another means, in addition to the cooling water 20, of subcooling the exhaust steam exiting the turbine 16. However, this process also serves to warm the condensate with the exhaust steam so that less energy is needed by the steam generator 14 to heat the condensate into steam. Thus, the present invention provides for the increased efficiency of the turbine by subcooling but does not lose efficiency in the overall cycle by warming the condensate with the exhaust steam prior to reaching the steam generator 14.

The condensate acts to remove the latent heat of vaporization of the steam exiting the turbine 16 and entering the condenser 18. However, the steam still has to condense and then cool further to subcool. The subcooling process occurs via the cooling water 20 running through the fluid flow system.

Since the efficiency of the steam plant cycle 12 increases in direct relation to the amount of heat energy that can be put back into the condensate prior to entering the steam generator 14, it is preferable for the condensate pump 22 to pump the condensate through a pathway, via condensate entry pipe 24, that allows the steam exiting the turbine 16 to pass over the condensate entry pipe 24 prior to reaching the cooling water 20. By using the steam with the most heat energy, more heat will be transferred back to the condensate. However, placing the condensate entry pipe 24 anywhere within the condenser 18 will provide some level of benefit in accordance with the present invention.

As will be appreciated by consideration of the embodiment illustrated in FIG. 1, the present invention provides a combined circulation condenser that increases the efficiency of a steam cycle to a level heretofore unknown in the art.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A combined circulation condenser for a steam cycle apparatus, comprising:

a condenser that is adapted to receive an exhaust steam generated by said steam cycle apparatus;

a fluid flow system for controllably directing cooling water along a first pathway through said condenser according to the operation of said turbine, whereby said cooling water cools said exhaust steam to form condensate;

a condensate pump adapted to receive said condensate; and a condensate entry pipe extending from said condensate pump through said condenser;

wherein said condensate pump collects and pumps said condensate through said condensate entry pipe extending through said condenser, whereby said exhaust steam passes over said condensate entry pipe such that said condensate passing through said condensate entry pipe additionally cools said exhaust steam and said exhaust steam warms said condensate in said condensate entry pipe.

2. The condenser according to claim 1, wherein said exhaust steam passes over said condensate entry pipe prior to passing over said first pathway.

3. A steam cycle apparatus, comprising:

a steam generator including an output port and an input port adapted to receive a fluid, wherein said steam generator presents heat to said fluid to generate steam that is directed out of said output port;

a turbine having an inlet and an outlet, wherein said inlet is adapted to receive said steam from said steam generator and said turbine generates electrical power;

a condenser connected to said outlet, wherein said outlet is adapted to present an exhaust steam to said condenser and said condenser condenses said exhaust steam;

a fluid flow system for controllably directing cooling water along a first pathway through said condenser according to the operation of said turbine, whereby said cooling water cools said exhaust steam to form condensate;

a condensate pump adapted to receive said condensate; and a condensate entry pipe extending from said condensate pump through said condenser, said condensate entry pipe forming part of a second pathway;

wherein said condensate pump collects and pumps said condensate through said condensate entry pipe extending through said condenser, whereby said exhaust steam passes over said condensate entry pipe such that said condensate passing through said condensate entry pipe additionally cools said exhaust steam and said exhaust steam warms said condensate in said condensate entry pipe; and wherein said second pathway directs said condensate to a feed pump, wherein said feed pump is adapted to receive said condensate and pumps said condensate back to said steam generator through said input port.

4. The steam cycle apparatus according to claim 3, wherein said exhaust steam passes over said condensate entry pipe prior to passing over said first pathway.

* * * * *